US010354849B2

(12) United States Patent
Denny et al.

(10) Patent No.: US 10,354,849 B2
(45) Date of Patent: Jul. 16, 2019

(54) METHOD OF RECORDING ADC SATURATION

(71) Applicant: Micromass UK Limited, Wilmslow (GB)

(72) Inventors: Richard Denny, Staffordshire (GB); Anthony James Gilbert, High Peak (GB); Martin Raymond Green, Bowden (GB); Steven Derek Pringle, Darwen (GB); Garry Michael Scott, Wigan (GB); Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 217 days.

(21) Appl. No.: 14/902,882

(22) PCT Filed: Jul. 9, 2014

(86) PCT No.: PCT/GB2014/052095
§ 371 (c)(1),
(2) Date: Jan. 5, 2016

(87) PCT Pub. No.: WO2015/004459
PCT Pub. Date: Jan. 15, 2015

(65) Prior Publication Data

US 2016/0155621 A1 Jun. 2, 2016

(30) Foreign Application Priority Data

Jul. 9, 2013 (EP) ..... 13175697
Jul. 9, 2013 (GB) ..... 1312266.8

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
CPC ..... H01J 49/0036; H01J 49/40
USPC ..... 702/189
See application file for complete search history.

(56) References Cited

U.S. PATENT DOCUMENTS 6,870,156 B2 3/2005 Rather
6,969,847 B2 11/2005 Davis et al.
7,683,314 B2 3/2010 Green et al.
8,063,358 B2 11/2011 Bateman et al.
8,324,569 B2 12/2012 Kajihara
8,941,056 B2 1/2015 Green et al.
(Continued)

*Primary Examiner* — Marc Anthony Armand
(74) *Attorney, Agent, or Firm* — Womble Bond Dickinson (US) LLP; Deborah M. Vernon; Health T. Misley

(57) ABSTRACT

A method of mass spectrometry is disclosed comprising digitizing a plurality of individual signals or transients and summing the plurality of digitized signals or transients or data relating to the plurality of digitized signals or transients to generate a composite mass spectral data set. The method further comprises determining in relation to the composite mass spectral data set an indication of the proportion of instances that intensity values relating to the individual digitized signals or transients either: (i) exceeded or approached a threshold value; (ii) suffered from saturation or approached saturation; or (iii) resulted from the dynamic range of an ion detector system being exceeded or approached.

18 Claims, 3 Drawing Sheets

(56) References Cited

U.S. PATENT DOCUMENTS

| | | | | |
|---|---|---|---|---|
| 2008/0029697 | A1* | 2/2008 | Willis | H01J 49/0036 250/287 |
| 2010/0213361 | A1* | 8/2010 | Green | H01J 49/0036 250/252.1 |
| 2011/0049353 | A1 | 3/2011 | Gilbert et al. | |
| 2011/0226943 | A1 | 9/2011 | Rather | |
| 2013/0268212 | A1* | 10/2013 | Makarov | H01J 49/025 702/32 |
| 2013/0338935 | A1 | 12/2013 | Watanabe et al. | |
| 2014/0005954 | A1 | 1/2014 | Richardson et al. | |
| 2015/0287578 | A1* | 10/2015 | Bendall | H01J 49/0004 250/282 |
| 2015/0371836 | A1 | 12/2015 | Rather | |

* cited by examiner

METHOD OF RECORDING ADC SATURATION

CROSS-REFERENCE TO RELATED APPLICATION

This application is the National Stage of International Application No. PCT/GB2014/052095, filed 9 Jul. 2014 which claims priority from and the benefit of United Kingdom patent application No. 1312266.8 filed on 9 Jul. 2013 and European patent application No. 13175697.5 filed on 9 Jul. 2013. The entire contents of these applications are incorporated herein by reference.

BACKGROUND OF THE PRESENT INVENTION

The present invention relates to a method of mass spectrometry and a mass spectrometer. The preferred embodiment relates to digitising a plurality of individual signals or transients using an Analogue to Digital Converter ("ADC") and summing the digitised signals or transients or time and intensity values relating to the digitised signals or transients to generate a composite mass spectrum.

It is known to record or digitise individual signals or transients arising from ion arrivals at an ion detector or electron multiplier using an Analogue to Digital recorder or an Analogue to Digital Converter ("ADC"). Orthogonal acceleration Time of Flight mass spectrometers may digitise ion arrival signals or transients relating to many thousands of individual time of flight separations. The digitised signals or transients are summed to produce a final summed or composite time of flight mass spectrum.

Each individual time of flight spectrum, signal or transient may be processed in real time before summing. In the simplest case this processing may be the application of an amplitude threshold to isolate signal arising from ion arrivals from background noise or baseline noise. The signal at individual digitised samples (i.e. individual ADC time bins) or within a time of flight spectrum which is above the threshold is recorded and all other samples or intensity values in ADC time bins are set to zero or to a baseline value. Such a method is disclosed, for example, in US 2011/0049353 (Micromass).

Multiple time of flight spectra processed in this way may then be summed or averaged to generate a final summed spectrum with reduced noise.

It is also known to process individual signals or transients which have been digitised to reduce the ion arrival signals or transients into time and intensity pairs. Such a method is disclosed, for example, in U.S. Pat. No. 8,063,358 (Micromass).

Individual signals or transients which are reduced to time and intensity pairs may then be summed with other time and intensity pairs relating to other time of flight spectra, signals or transients in order to produce a final summed, composite or average spectrum. This method advantageously substantially removes the profile or line width of the digitised signal from the final summed spectra thereby increasing the effective time of flight resolution.

It is known that at high ion arrival rates the intensity of one or more digitisation samples (i.e. the signal intensity during an ADC time bin) may exceed the dynamic range of the ADC. As a result, the intensity value will be saturated. This saturation leads to errors in the final intensity and/or temporal position of the summed spectrum.

State of the art electron multipliers or photo multipliers produce signals of statistically varying intensity for identical numbers of arriving ions of the same charge state and mass to charge value. The intensity probability distribution is known as the pulse height distribution ("PHD") of the ion detector. For many Time of Flight ion detectors the PHD may be approximated by a Gaussian distribution with a mean approximately the same as the FWHM.

It is common that a spectral peak resulting from summing multiple digitised signals can contain a proportion of signals wherein the ion arrival intensity saturated the ADC and hence the recorded intensity values in some of the ADC time bins is saturated.

The response of the ion detector is mass to charge ratio and charge state dependent due to differences in electron yield related to the velocity and energy of primary ion strikes. If the charge state is not known then the average ion arrival rate cannot be estimated.

A further complication is that an instrument parameter may be stepped, scanned or otherwise varied during the summation time of the individual time of flight spectra. For example, the collision energy or RF amplitude of an ion-optical component may be varied during the summation period to optimize conditions across a wide mass to charge ratio range. In this case the ion arrival rate may change during summation. However, the ion arrival rate cannot be easily estimated for any particular mass to charge ratio value.

Ions may also be delivered to a Time of Flight mass analyser at different ion arrival rates during the summation due to other effects such as pre-separation by ion mobility or by virtue of using a Matrix Assisted Laser Desorption Ionisation ("MALDI") or other pulsed ion source.

In addition, many sample introduction techniques produce ion currents which vary rapidly with time including chromatographic, distillation and vaporization introduction techniques.

US 2011/0226943 (Räther) discloses a method of correcting an individual ion signal or transient which suffers from saturation. According to an arrangement a field programmable gate array ("FPGA") counts the measured values of an individual digitised ion signal or single digitised transient which are in saturation. An arithmetic unit then adds a corrected measurement value from a table to the sum spectra at the position of the time of flight that corresponds to the centre of the saturation range.

WO 2012/095647 (Micromass) discloses a method of processing multidimensional mass spectrometry data, wherein the multidimensional data may comprise liquid chromatography retention time and time of flight data. Regions of interest are identified within the raw multidimensional data and peak detection is used to account for mass and/or intensity errors in the raw data arising from hardware limitations (e.g. TDC deadtime) so as to produce an improved data set.

GB-2417125 (Micromass) discloses an ion beam attenuator wherein the degree of attenuation may be varied by varying a mark space ratio of the attenuator. The attenuator may be switched between two modes of operation and mass spectral data may be obtained in both modes of operation (e.g. 100% transmission and 2% transmission). The mass spectral data in the 100% transmission mode may be interrogated and any mass peaks which are suffering from saturation may be flagged. A final composite mass spectrum may be obtained using a combination of both high transmission mass spectral data and low transmission mass spectral (where the corresponding high transmission mass spectral data suffers from saturation).

WO 2012/080443 (Makarov) discloses a data acquisition system comprising two detectors for outputting two detection signals in separate channels in response to ions arriving at the detection system. Two aligned signals in separate channels CH1 and CH2 are input to a merge module, wherein a merged (HDR) spectrum is generated. The module uses a high gain channel CH2 to provide the peaks for the merged HDR spectrum except where the high gain detection signal is saturated (e.g. as detected from the presence of an overflow flag associated with the peak in the high gain detection signal). Where saturation of a peak occurs in the high gain channel CH2, the corresponding peak from the low gain channel CH1 and signal is instead used for the merged HDR spectrum.

GB-2457112 (Micromass) discloses a method of detecting ions wherein an ion detector is arranged simultaneously to output first and second signals. The two signals are digitised and ion peaks having an intensity corresponding with a full scale digitised output are flagged. If ion peaks in the second signal are flagged as suffering from saturation then corresponding mass spectral data from the first signal is utilised.

It is desired to provide an improved mass spectrometer and method of mass spectrometry.

SUMMARY OF THE PRESENT INVENTION

According to an aspect of the present invention there is provided a method of mass spectrometry comprising:

digitising a plurality of individual signals or transients;

summing the plurality of digitised signals or transients or data relating to the plurality of digitised signals or transients to generate a composite mass spectral data set; and determining in relation to the composite mass spectral data set an indication of the proportion of instances that intensity values relating to the individual digitised signals or transients either: (i) exceeded or approached a threshold value; (ii) suffered from saturation or approached saturation; or (iii) resulted from the dynamic range of an ion detector system being exceeded or approached.

According to another aspect of the present invention there is provided a method of mass spectrometry comprising:

digitising a plurality of individual signals or transients;

summing the plurality of digitised signals or transients or data relating to the plurality of digitised signals or transients to generate a composite mass spectral data set; and determining in relation to the composite mass spectral data set a measure, total or tally of the number of intensity values relating to the individual digitised signals or transients which either: (i) exceed or approach a threshold value; (ii) suffer from saturation or approach saturation; or (iii) result from the dynamic range of an ion detector system being exceeded or approached.

US 2011/0226943 (Rather) does not teach or suggest determining in relation to a composite mass spectral data set an indication of the proportion of instances that intensity values relating to individual digitised signals or transients either: (i) exceeded a threshold value; (ii) suffered from saturation; or (iii) resulted from the dynamic range of an ion detector system being exceeded.

According to the arrangement disclosed in WO 2012/095647 (Micromass) a filter may be applied following detection of a region of interest so that potentially time consuming detailed analysis of regions of interest may be restricted to those that are likely to yield useful information. A filter criteria may include a quality flag such as saturation. Accordingly, detailed analysis may not be performed if the data is determined to be suffering from saturation. According to the arrangement disclosed in WO 2012/095647 (Micromass) corrected time of flight or intensity measurements may be stored together optionally with a saturation flag i.e. the stored data may include metadata which indicates whether or not the data was suffering from saturation.

However, WO 2012/095647 (Micromass) does not teach or suggest determining in relation to a composite mass spectral data set an indication of the proportion of instances that intensity values relating to individual digitised signals or transients either: (i) exceeded a threshold value; (ii) suffered from saturation; or (iii) resulted from the dynamic range of an ion detector system being exceeded.

GB-2417125 (Micromass) discloses flagging mass peaks which are believed to suffer from saturation. However, GB-2417125 (Micromass) does not teach or suggest determining in relation to a composite mass spectral data set an indication of the proportion of instances that intensity values relating to individual digitised signals or transients either: (i) exceeded a threshold value; (ii) suffered from saturation; or (iii) resulted from the dynamic range of an ion detector system being exceeded.

WO 2012/080443 (Makarov) does not teach or suggest determining in relation to a composite mass spectral data set an indication of the proportion of instances that intensity values relating to individual digitised signals or transients either: (i) exceeded a threshold value; (ii) suffered from saturation; or (iii) resulted from the dynamic range of an ion detector system being exceeded.

GB-2457112 (Micromass) discloses flagging mass peaks which are believed to suffer from saturation. However, GB-2457112 (Micromass) does not teach or suggest determining in relation to a composite mass spectral data set an indication of the proportion of instances that intensity values relating to individual digitised signals or transients either: (i) exceeded a threshold value; (ii) suffered from saturation; or (iii) resulted from the dynamic range of an ion detector system being exceeded.

The step of digitising the plurality of individual signals or transients preferably further comprises digitising each individual signal or transient into a plurality of intensity values distributed across a plurality of sample bins.

The step of determining in relation to the composite mass spectral data set a measure, total or tally of the number of intensity values relating to the individual digitised signals or transients which either: (i) exceed or approach a threshold value; (ii) suffer from saturation or approach saturation; or (iii) result from the dynamic range of an ion detector system being exceeded or approached preferably further comprises:

determining a measure, total or tally of the number of sample bins, preferably consecutive sample bins, relating to at least some or all of the digitised signals or transients which have a corresponding intensity value indicative that an ion detector system is suffering from saturation or is approaching saturation.

The method preferably further comprises digitising each individual signal or transient using an Analogue to Digital Converter.

Each individual signal or transient is preferably digitised into a plurality of intensity values distributed across a plurality of sample bins.

The sample bins preferably comprise time bins.

The step of digitising the plurality of individual signals or transients preferably further comprises determining one or more ion peaks in an individual signal or transient and representing each ion peak as either: (i) an intensity value and a corresponding time, mass or mass to charge ratio value; (ii) an area value and a corresponding time, mass or mass to charge ratio value; or (iii) two or more intensity or area values and two or more corresponding time, mass or mass to charge ratio values.

The step of summing data relating to the plurality of digitised signals or transients preferably comprises summing a plurality of the intensity or area values and the corresponding time, mass or mass to charge ratio values to generate the composite mass spectral data set.

The method preferably further comprises generating an individual signal or transient in response to ions arriving at an ion detector.

The method preferably further comprises mass analysing ions using a mass analyser.

The method preferably further comprises mass analysing ions using a Time of Flight mass analyser.

The method preferably further comprises admitting a single pulse of ions into the mass analyser, wherein an individual signal or transient results from detecting the ions comprising the single pulse of ions.

The method preferably further comprises injecting a packet of ions into a time of flight or drift region of the mass analyser, wherein an individual signal or transient results from detecting the ions in a single packet of ions which is injected into the time of flight or drift region.

The method preferably further comprises determining for at least some or all of the individual digitised signals or transients which sample bins have an intensity value which either: (i) exceeds a threshold value; (ii) suffers from saturation; or (iii) results from the dynamic range of an ion detector system having been exceeded.

The method preferably further comprises determining for at least some or all of the individual digitised signals or transients which sample bins have a non-zero intensity value or an intensity value indicative of a signal above background noise.

The method preferably further comprises determining in relation to at least some or all of the sample bins of the composite mass spectral data set a ratio A:B indicative of the proportion of instances that intensity values relating to the individual digitised signals or transients either: (i) exceeded or approached a threshold value; (ii) suffered from saturation or approached saturation; or (iii) resulted from the dynamic range of an ion detector system being exceeded or approached.

Preferably, A is the number of instances that a particular sample bin of the composite mass spectral data set includes an intensity value related to an individual digitised signal or transient which either: (i) exceeds or approaches a threshold value; (ii) suffers from saturation or approaches saturation; or (iii) results from the dynamic range of an ion detector system having been exceeded or approached.

Preferably, B is the total number of individual digitised signals or transients which were summed, or the total number of individual digitised signals or transients having a non-zero intensity value or an intensity value indicative of a signal above background noise, or the total number of individual digitised signals or transients having a non-zero intensity value or an intensity value indicative of a signal above background noise for a particular sample bin.

The method preferably further comprises determining one or more ion peaks in each signal or transient.

The method preferably further comprises determining an intensity or area value related to the one or more ion peaks.

The method preferably further comprises determining a mass, mass to charge ratio or time value related to the one or more ion peaks.

The step of summing data related to the plurality of digitised signals or transients preferably comprises summing intensity or area values and/or mass, mass to charge ratio or time values.

The method preferably further comprises summing multiple digitised signals or transients to form a summed signal.

The method preferably further comprises determining one or more ion peaks in the summed signal.

The method preferably further comprises determining an intensity or area value related to the one or more ion peaks.

The method preferably further comprises determining a mass, mass to charge ratio or time value related to the one or more ion peaks.

The step of summing data related to the plurality of digitised signals or transients preferably comprises summing intensity or area values and/or mass, mass to charge ratio or time values related to the summed signal with intensity or area values and/or mass, mass to charge ratio or time values related to other summed signals.

The method preferably further comprises flagging one or more regions of the composite mass spectral data set as either: (i) having exceeded or approached a threshold value; (ii) suffering from saturation or approaching saturation; or (iii) resulting from the dynamic range of an ion detector system having been exceeded or approached.

The method preferably further comprises applying a statistical correction to one or more regions of the composite mass spectral data set and/or substituting one or more regions of the composite mass spectral data set with corresponding mass spectral data which is substantially unsaturated, less distorted or otherwise improved.

The method preferably further comprises altering an operating parameter of a mass spectrometer in response to determining one or more regions of the composite mass spectral data set as either: (i) having exceeded or approached a threshold value; (ii) suffering from saturation or approaching saturation; or (iii) resulting from the dynamic range of an ion detector system having been exceeded or approached.

The threshold value preferably comprises the ratio A:B as described above.

The step of altering an operating parameter of a mass spectrometer preferably comprises altering or reducing an ion transmission efficiency of an ion transmission control device and/or altering or reducing a gain of an ion detector so as to reduce the effects of saturation or to prevent exceeding the dynamic range of an ion detector system in subsequently acquired individual signals or transients or in subsequently acquired composite mass spectral data.

The step of altering an operating parameter of a mass spectrometer preferably comprises altering or reducing an ionisation efficiency of an ion source so as to reduce the effects of saturation or to prevent exceeding the dynamic range of an ion detector system in subsequently acquired individual signals or transients or in subsequently acquired composite mass spectral data.

The method preferably further comprises separating ions according to one or more physico-chemical properties.

The one or more physico-chemical properties preferably comprises mass, mass to charge ratio, ion mobility or differential ion mobility.

According to an aspect of the present invention there is provided a mass spectrometer comprising:

a digitiser arranged and adapted to digitise a plurality of individual signals or transients; and a control system arranged and adapted:

to sum the plurality of digitised signals or transients or data relating to the plurality of digitised signals or transients to generate a composite mass spectral data set; and to determine in relation to the composite mass spectral data set an indication of the proportion of instances that intensity values relating to the individual digitised signals or transients either: (i) exceeded or approached a threshold value; (ii) suffered from saturation or approached saturation; or (iii) resulted from the dynamic range of an ion detector system being exceeded or approached.

According to an aspect of the present invention there is provided a mass spectrometer comprising:

a digitiser arranged and adapted to digitise a plurality of individual signals or transients; and a control system arranged and adapted:

to sum the plurality of digitised signals or transients or data relating to the plurality of digitised signals or transients to generate a composite mass spectral data set; and to determine in relation to the composite mass spectral data set a measure, total or tally of the number of intensity values relating to the individual digitised signals or transients which either: (i) exceed or approach a threshold value; (ii) suffer from saturation or approach saturation; or (iii) result from the dynamic range of an ion detector system being exceeded or approached.

The digitiser preferably comprises an Analogue to Digital Converter.

The mass spectrometer preferably further comprises a Time of Flight mass analyser.

According to an aspect of the present invention there is provided a method of mass spectrometry comprising:

digitising a plurality of individual signals or transients;

summing the plurality of digitised signals or transients or data relating to the plurality of digitised signals or transients to generate a composite mass spectral data set; and determining in relation to the composite mass spectral data set an indication of the proportion of instances that intensity values relating to the individual digitised signals or transients either: (i) exceeded a threshold value; (ii) suffered from saturation; or (iii) resulted from the dynamic range of an ion detector system being exceeded.

According to an aspect of the present invention there is provided a mass spectrometer comprising:

a digitiser arranged and adapted to digitise a plurality of individual signals or transients; and a control system arranged and adapted:

to sum the plurality of digitised signals or transients or data relating to the plurality of digitised signals or transients to generate a composite mass spectral data set; and to determine in relation to the composite mass spectral data set an indication of the proportion of instances that intensity values relating to the individual digitised signals or transients either: (i) exceeded a threshold value; (ii) suffered from saturation; or (iii) resulted from the dynamic range of an ion detector system being exceeded.

According to an aspect of the present invention there is provided a method of mass spectrometry comprising:

separating ions according to one or more physico-chemical properties;

generating a signal in response to an ion arrival at an ion detector;

digitising and recording the signal using an Analogue to Digital Converter ("ADC");

determining the number of digitisation samples in the signal which exceed the dynamic range of the ADC;

summing multiple signals resulting from multiple separations; and recording the relative proportion of instances at which the intensity recorded in the digitised samples has exceeded the dynamic range of the ADC for each signal or each digitised sample or group of samples.

The method preferably further comprises using the stored information and final summed spectrum to flag, correct, filter or reject peaks in the final summed spectra or to adjust an instrument parameter based on the information preferably such that the dynamic range of the data is adjusted.

According to the preferred embodiment of the present invention multiple ions arrive at an ion detector over a period of time and the signal from these ion arrivals is preferably summed into a single composite spectrum over this time period. At the same time a representative and reliable measure of the extent of saturation is preferably recorded with the data regardless of how the ion arrival rate or intensity may have changed over the time period and without prior knowledge of how the ion arrival rate may have varied. This record may be used in various different ways to improve the overall quality of the data.

The present invention relates to a method of calculating the proportion or extent of saturation during signal digitisation and storing this information with final summed data to allow subsequent data dependent actions.

The preferred embodiment provides information related to the distribution of signal heights. This information can be stored within discreet regions of a final summed data set.

According to known approaches it is assumed that during a signal summation, integration or averaging period that the ion arrival rate and or ion pulse height distribution does not change significantly or changes in a substantially identical manner for ions of all mass to charge ratio values. An estimation of the ion arrival rate and hence the extent to which the digitised signals exceed the dynamic range of the acquisition system may be made based solely on the intensity of the summed data.

The intensity of the final summed data for a given mass to charge ratio value may be used to estimate when unacceptable saturation has occurred. This may be by empirically determining the intensity at which distortion of quantitative performance or mass measurement accuracy degrades. Alternatively, a determination as to whether the final summed data suffers from unacceptable saturation may be calculated by estimating the number of ion arrivals per unit time based on the average response of an ion arrival at the detector, knowledge of the form and the mass to charge ratio and charge state dependency of the PHD.

According to the preferred embodiment the intensity maxima in the final data may be used to flag the data as saturated and/or apply a statistical correction to the data and/or prompt an operating parameter of the mass spectrometer to be changed (e.g. to attenuate the signal by a known amount to reduce the extent of digitizer saturation for a subsequent spectra).

In many cases the ion flux or ion arrival rate changes during the summation period. These changes may be mass to charge ratio, charge state and or ion mobility dependent. Unless the nature of the change in ion flux is known for each species it is not possible to accurately estimate the extent to which an individual species in the summed data is in saturation.

According to the preferred embodiment a record of whether the digitised signal has exceeded the dynamic range of the acquisition system is associated with the summed data for each ion arrival of each species or for each digitisation sample. This record preferably provides an accurate representation of the extent of saturation of signals in the final summed data set regardless of how the ion flux may have changed during summation.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak;

(v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A preferred mode of operation of an orthogonal acceleration Time of Flight mass spectrometer will now be described in order to illustrate various aspects of the present invention. Although the preferred embodiment relates to an ADC detector system it should be understood that the present invention is not limited to an ADC detector system nor to a Time of Flight mass analyser.

According to the preferred embodiment individual signals, time of flight spectra or transients are digitised by an ADC. A time and intensity value for each ion peak in a single time of flight spectrum, signal or transient is then preferably determined. The time and intensity values as determined for each separate time of flight spectrum, signal or transient are then preferably summed.

Alternatively, several time of flight spectra, signals or transients may first be combined and then time and intensity values may be determined for the combined data. The time and intensity values may then be summed with other time and intensity values.

According to the present invention in addition to producing final summed data, a value is also preferably recorded for each digitisation point, ADC time bin or detected signal or time intensity pair. The recorded value preferably corresponds to the number of times that the individual signals or transients which make up the composite data exceeded the dynamic range of the ADC. In particular, the recorded value preferably corresponds with the proportion of time that the individual signals or transients were saturated out of the total number of times that a signal was recorded.

As time of flight spectra, signals or transients are summed, or at the end of a summation period each data point, ADC time bin or group of data points or ADC time bins in the final summed spectra is preferably associated with a value corresponding to the proportion of saturated signals. This provides a measure of the amount of saturation and hence amount of possible distortion of individual peaks regardless of how the ion arrival rate may have changed over the summation time.

In order to illustrate aspects of the present invention data was obtained using an 8 bit ADC. If the digitised signal in a particular ADC sample bin exceeds 255 least significant bits ("LSB") then the ADC is considered to be in saturation. It will be understood that when the signal from an ADC suffers from saturation then the intensity of the signal in the sample cannot be accurately determined.

Figure 1A:
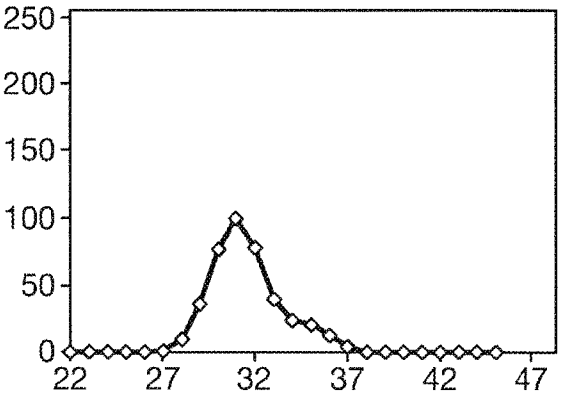
FIG. 1A shows a first digitised signal or transient.
Figure 1B:
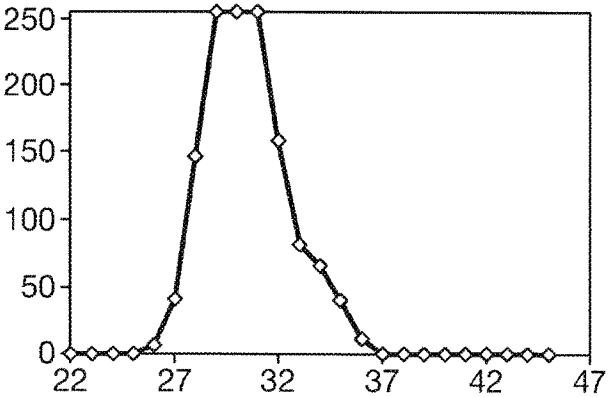
FIG. 1B shows a second digitised signal or transient.
Figure 1C:
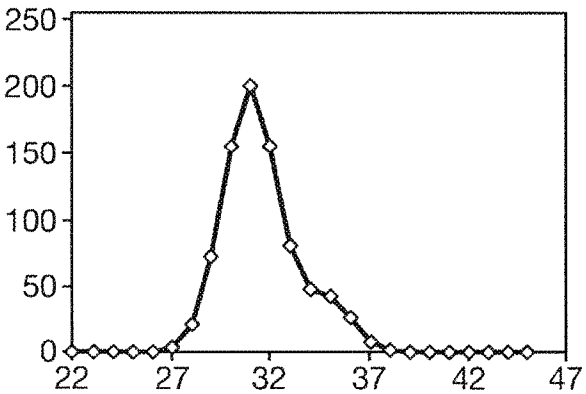
FIG. 1C shows a third digitised signal or transient and FIG. 1D shows a summed signal resulting from combining or summing the three digitised signals or transients shown in FIGS. 1A-1C.

FIGS. 1A-C show three consecutive digitised signals, time of flight spectra or transients relating to three consecutive time of flight separations or acquisitions.

The digitised signal relating to the first digitised signal, time of flight spectrum or transient as shown in FIG. 1A and the digitised signal relating to the third digitised signal, time of flight spectrum or transient as shown in FIG. 10 are both within 255 LSB and hence these two digitised signals or transients do not suffer from saturation. However, the signal height of the second digitised signal, time of flight spectrum or transient as shown in FIG. 1B exceeds the dynamic range of the ADC and a signal intensity of 255 LSB is recorded for three out of the 24 ADC digitisation time bins shown. In particular, it is apparent that ADC time bins #29, #30 and #31 suffer from saturation.

Figure 1D:
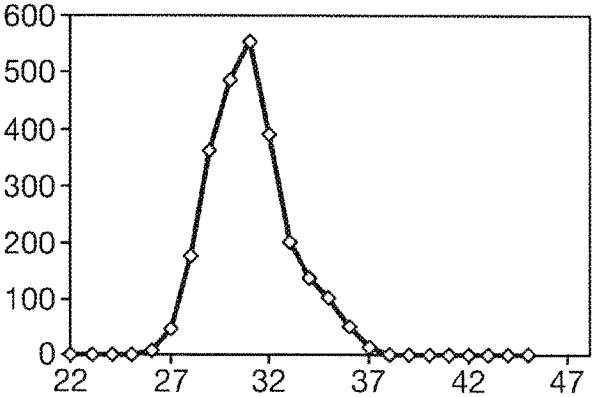

FIG. 1D shows a summed spectrum corresponding to the sum of the three digitised signals, time of flight spectra or transients as shown in FIGS. 1A-1C.

Figure 2A:
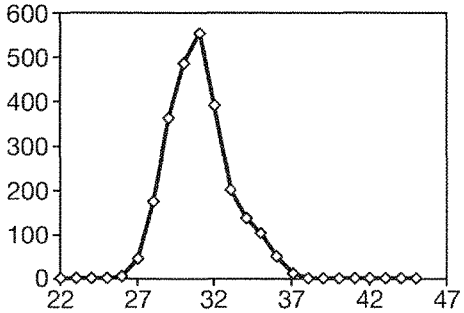
FIG. 2A shows the summed data shown in FIG. 1D.

FIG. 2A shows the same summed data as shown in FIG. 1D.

Figure 2B:
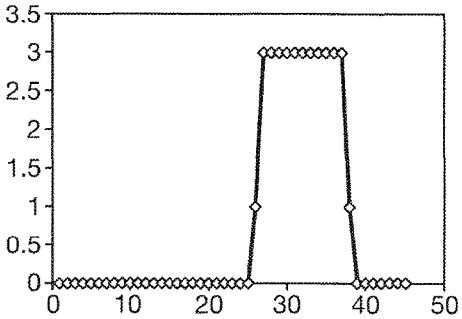
FIG. 2B shows a histogram of the number of times that the ADC time bins relating to the three signals or transients shown in FIGS. 1A-1C have a non-zero intensity.
Figure 2C:
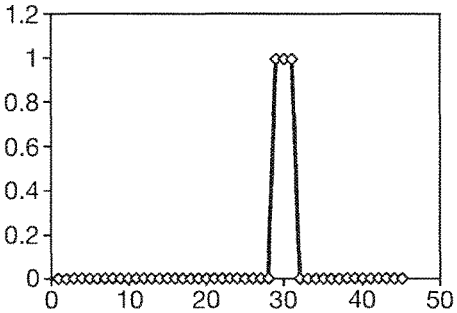
FIG. 2C shows a histogram of the number of times that the ADC time bins relating to the three signals or transients shown in FIGS. 1A-1C have an intensity which exceeds 254 LSB and FIG. 2D shows the proportion of time that the intensity value recorded in an ADC time bin exceeded 254 LSB.
Figure 2D:
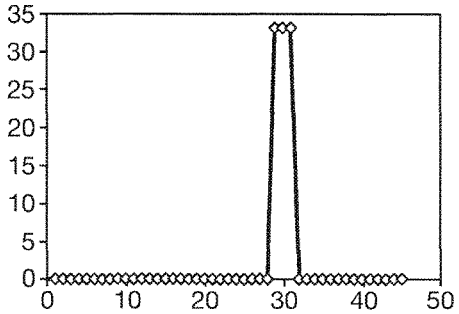

FIGS. 2B-2D illustrate the nature of the additional information which is preferably stored with each digitisation point or ADC time bin according to the preferred embodiment of the present invention. It will be appreciated that known detector systems do not calculate or retain the additional information as shown in FIGS. 2B-2D.

FIG. 2B shows a histogram related to the summed data shown in FIG. 2A. The histogram shown in FIG. 2B shows the number of times each of the 45 ADC time bins has a non-zero intensity value in relation to the three signals, time of flight spectra or transients shown in FIGS. 1A-1C. It will be apparent that in relation to the summed data, that ADC time bins #26 through to #38 have non-zero intensity values and furthermore that ADC time bins #26 through to #38 have non-zero intensities for each of the three signals, time of flight spectra or transients.

FIG. 2C shows a histogram of the number of times each ADC time bin has an intensity which exceeds 254 LSB (i.e. wherein the ion detector suffers from saturation) in relation to the three signals, time of flight spectra or transients shown in FIGS. 1A-1C. It will be appreciated that only one of the three signals, time of flight spectra or transients (namely the second signal, time of flight spectrum or transient as shown in FIG. 1B) suffers from saturation and that the second signal, time of flight spectrum or transient was only saturated during ADC time bins #29, #30 and #31. This is reflected in the histogram shown in FIG. 2C which indicates that in relation to the summed data that only ADC time bins #29, #30 and #31 have suffered from saturation and furthermore that these three ADC time bins were only saturated once.

FIG. 2D shows the percentage of time that intensity values recorded in any particular ADC time bin exceeded 254 LSB i.e. suffered from saturation. FIG. 2D shows that for 33% of the time ADC time bins #29, #30 and #31 suffered from saturation whilst none of the other ADC time bins suffered from saturation.

In state of the art Time of Flight mass spectrometers digitised signals or transients from many thousands of separate time of flight separations or transients are summed to form a final composite time of flight spectrum or mass spectrum. According to the preferred embodiment each (or at least some) digitisation sample(s) or ADC time bin(s) in the final summed data may be assigned a value corresponding to the proportion of saturated events.

According to a preferred embodiment a complete histogram of the number of non-zero intensity values (in a similar manner to the histogram shown in FIG. 2B) and/or a histogram relating to the number of intensity values which exceeded a predetermined saturation threshold (in a similar manner to the histogram shown in FIG. 2C) may be stored with the summed data. The proportion of saturation per sample or ADC time bin (in a similar manner to the histogram shown in FIG. 2D) may be calculated at a later time.

Another preferred method of recording the proportion of saturated peaks is to calculate the proportion of saturated intensities as the individual time of flight spectra are summed. In this case only a value corresponding to the proportion of saturation is ultimately stored alongside the summed data. This value may be held to a relatively low precision. For example, according to an embodiment the proportion of saturation may be recorded as a value ranging from 0 (corresponding to no saturated samples) to 1 (corresponding to 100% of the intensity values recorded in a sample being saturated). The value of proportion of saturation may be stored in increments of 1% or 5% or 10% to reduce the memory or storage requirements.

Other ways of reducing the amount of data recorded or stored with the final data are contemplated.

Figure 3:
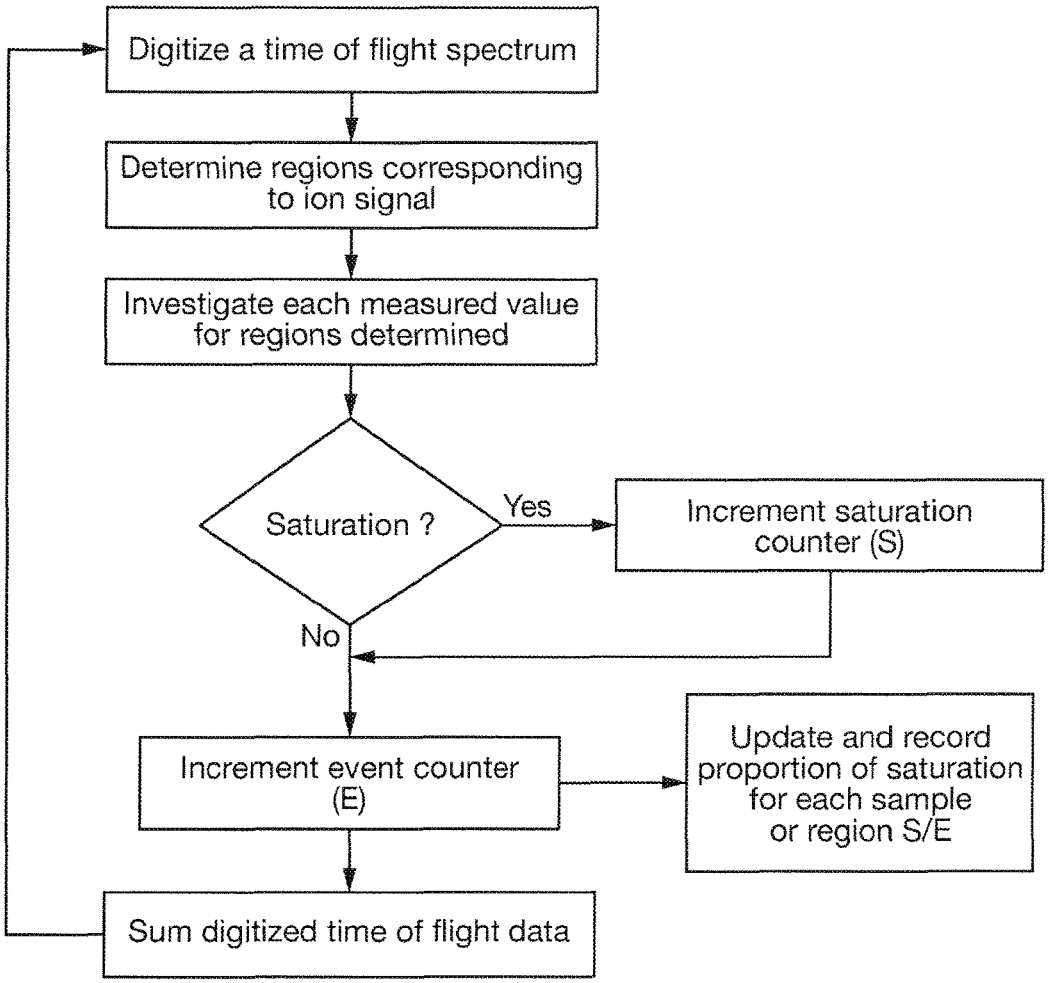
FIG. 3 shows a generalised flow diagram illustrating steps of a preferred embodiment of the present invention.

FIG. 3 shows a generalised flow diagram illustrating various steps according to a preferred embodiment of the present invention. As shown in FIG. 3, a single time of flight spectrum or single transient is preferably digitised. ADC time bins having an intensity value which corresponds to one or more ion peaks in the single time of flight spectrum or transient are then determined.

According to the preferred embodiment an investigation is then made to see whether or not any of the individual ADC time bins corresponding to an ion peak have an intensity value indicative of saturation. If a particular ADC time bin has an intensity value indicative of saturation then a saturation counter S for that particular ADC time bin is preferably incremented.

After incrementing a saturation counter for any ADC time bin which has an intensity value indicative of saturation an event counter E is then also preferably incremented.

The ratio of saturation events S to total events E is then preferably updated for each ADC time bin. The digitised time of flight data is then preferably summed with other acquired time of flight data.

According to an embodiment a measure of whether the proportion of saturated intensities has exceeded a predetermined value may be recorded with each sample or ADC time bin of the final summed or composite data or in respect of one or more regions of the final summed or composite data. For example, it may be empirically determined that no significant or unacceptable distortion of intensity or mass measurement occurs below a certain proportion of saturation. According to an embodiment it may be desired only to record if a sample or ADC time bin within a final summed histogram or a region of the final summed or composite data has a proportion of saturation above or below this value.

One method of achieving this is to allocate a number of registers, one for each sample point of length n. The value in the registers may be set to n/2. If, when a sample point is added to the summed histogram the intensity is greater than 0 but less than the intensity set as indicating saturation then the register value is preferably decremented by a predetermined decrement value D. If the intensity is greater than the intensity set as indicating saturation then the register value is preferably incremented by a predetermined increment value I.

At the end of the summation period the value of each register may then be read or otherwise utilised.

For illustrative purposes, the decrement value D and the increment value I may both be set to be 1. If, after summation of data, when a register is read the register value is less than n/2 then on average less than 50% of the individual sample intensities summed for this sample or ADC time bin exceeded the dynamic range of the ADC. If the register value when read is greater than n/2, then on average greater than 50% of the individual sample intensities summed for this sample or ADC time bin exceeded the dynamic range of the ADC. According to an embodiment a region of the final composite mass spectral data may be considered to be corrupted or otherwise suffering from an unacceptable level of saturation when corresponding ADC time bins have intensity values which are indicative of saturation for at least 50% of the individual signals or transients which were summed to form the final composite mass spectral data.

The target proportion of saturation value may be changed by changing the decrement and increment values. For example, if a decrement value D of 1 and an increment value I of 3 are set then a final register value of greater than n/2 will indicate that on average greater than 25% of the samples or ADC time bins summed contain saturated signals.

Individual data samples or ADC time bins in the final histogram may be flagged based on the register value as being either saturated or unsaturated.

According to an embodiment the above described approach may be utilised such that the target proportion of saturation may be arranged to be different depending on the mass or time of flight of an ion. This is advantageous if a change in ion arrival rate during an acquisition period is dependent upon the mass, time of flight or ion mobility drift time.

Individual digitised signals or transients arising from ion arrivals within individual time of flight separations are preferably reduced to time and intensity pairs or values before summing or compiling into a final composite data set.

Individual time and intensity pairs may interrogated during detection to determine if any of the samples or ADC time bins within the digitised signal exceed the dynamic range of the ADC. This information may be used to record the proportion of saturation in the final combined, composite, summed or histogrammed data set.

Although the preferred method described above allows indication of the proportion of saturation to be recorded for individual samples or ADC time bins in the final summed spectrum, no indication is given of the extent to which any particular sample, ADC time bin or time intensity pair exceeds the dynamic range of the ion detector.

According to an embodiment the extent or amount that individual digitised signals have exceeded the dynamic range of the ADC may be captured or determined by examining or determining how many consecutive samples or ADC time bins exceed the dynamic range of the ADC within a local region of the digitised signal within an individual time of flight separation, signal or individual transient.

For example, with reference to FIG. 1B three consecutive samples or individual ADC time bins exceed the dynamic range of the ADC. Although only approximate, this indicates that a larger proportion of the original signal has not been accurately represented during digitisation compared with a situation wherein a digitised signal has only a single sample or ADC time bin with an intensity value which exceeds the dynamic range of the ADC.

Individual signals with more points or more consecutive ADC time bins exceeding the dynamic range of the ADC are in general likely to suffer from a greater amount of distortion or are suffering from saturation to a greater extent.

To reflect this in the measurement of proportion of saturation, the number of counts added to a histogram of saturated signals such as shown in FIG. 2C may be varied or increased if more than one consecutive saturated sample or ADC time bin is detected in an individual signal or transient.

In this case, the final value of proportion of saturated points may be weighted with respect to the extent of saturation of the individual signals or ADC time bins.

Other information, such as the width of the digitised signal may also be used in conjunction with the number of saturated points to weight the contribution of a specific signal to the final record of proportion of saturation.

According to a preferred embodiment of the present invention the proportion of saturation is preferably saved for every sample point or ADC time bin in the final summed or combined output spectra. However, other embodiments are contemplated wherein only the proportion of saturation for a group of consecutive sample points or ADC time bins in the final summed or combined output spectrum may be saved. This can also reduce the amount of data which is required to be stored.

Once the proportion of saturation has been determined and a representative value has been stored with the raw data this value may be used in several different ways to enhance the operation of the mass spectrometer or enhance the data quality.

For example, distortion of the intensity or mass measurement or IMS drift time measurement, and hence collision cross section measurement and or LC or GC chromatographic retention time measurement may be corrected based on a predetermined relationship between the proportion of saturation and the shift in any these measurements.

Correction of the intensity of individual mass to charge ratio peaks enables the mass spectrometer to automatically correct for distortions in the IMS or chromatographic peak shape and hence peak detection of the IMS or chromatographic peak will yield not only more accurate area information but also more accurate elution time information.

In another example, individual peaks may be flagged or marked as exceeding a certain saturation level as a visual indication of possible data corruption.

The data corresponding to the proportion of saturation may be used to intelligently combine data from alternating non attenuated and attenuated data in a manner as described, for example, in U.S. Pat. No. 7,038,197 (Micromass). In this case, as the information is held within the continuum data prior to peak detection of the summed data, individual data points may be chosen from the attenuated and non attenuated data to produce a single composite continuum mass spectrum having an increased dynamic range.

The method according to the preferred embodiment may be performed during nested separations such as IMS-MS two dimensional data acquisition. This allows attenuated and non attenuated two dimensional continuum data sets to be combined to produce a wide dynamic range two dimensional data set.

The value of proportion of saturation as obtained according to the preferred embodiment may be used to trigger a change in an instrument parameter.

According to an embodiment data in the final summed spectrum may be flagged only once the proportion of saturation exceeds a certain threshold. According to an embodiment the appearance of a saturation flag may be monitored for. Data may be compared against an intensity threshold to predict how an instrument parameter should be adjusted. The intensity of data in summed spectra may not represent accurately the extent of saturation and therefore it is not necessarily possible to determine a suitable intensity threshold to avoid saturation. The presence of a flag corresponding to a fixed proportion of saturation may be used to learn or adjust the preset threshold dynamically.

For example, the intensity of a particular analyte may have exceeded the preset intensity threshold. However, a saturation flag may not be present. In this case the threshold used in the control of this analyte may be increased by a pre determined amount. Conversely, an analyte peak may be within the preset intensity threshold but a saturation flag is present. In this case the target intensity threshold may be reduced. In this way the target intensity threshold may, to some extent, adapt to keep the intensity of the target peak within correct limits regardless of how the ion arrival rate may have changed during the summation period.

In another embodiment, the proportion of saturation during the summation of the individual time of flight spectra may be monitored.

The summation may then be terminated when a targeted portion of the data exceeds a predetermined proportion of saturation to allow a system parameter to be changed. In this case the summation period depends on the nature of the data.

Alternatively, an instrument parameter may be changed during a summation period in response to monitoring the amount of saturation in a target region or regions of the data. In this case the summation period may be of fixed invariant duration.

For example, an attenuation lens may be dynamically adjusted during the summation period such that signal in a region of the summed data does not exceed a fixed saturation proportion. If the way in which attenuation has changed is known, the intensity of the final data may be corrected to reflect an estimation of the incoming ion beam.

Another way in which saturation information may be used to improve data quality is in combining data, before or after post processing, from several summed spectra over a chromatographic or IMS drift time peak. For example, a number of summed spectra containing a mass spectral peak from an analyte may be considered. Over a number of spectra the ion arrival rate can change dramatically e.g. as an analyte elutes from a chromatographic separation device. In this case the analyte peak in some of the spectra may be below the proportion of saturation where unacceptable distortion occurs. For other spectra, the same peak may be above the proportion of saturation. When several mass spectral peaks are combined, for example across an LC peak, the mass measurement accuracy of the final spectra may be distorted due to inclusion of saturated data. The presence of saturation flags in the data allows individual peaks containing saturated points to be excluded from the combined data, thus minimizing the extent of corruption in the final combined data.

As individual mass to charge ratio points in the final summed spectra contain information about the proportion of saturation, in chromatographic data the chromatographic retention time may be calculated from mass to charge ratio values which do not have unacceptable saturation. This avoids error in the calculation of retention time (RT) due to ADC saturation.

In an identical way when multi dimensional LC-IMS-MS data is acquired, IMS peaks for particular mass to charge ratios and chromatographic retention time which contain saturated data samples may be excluded when two dimensional data sets are summed over retention time or during calculation of IMS drift time. This avoids distortion in the measurement of collision cross section due to ADC saturation.

Similarly, chromatographic peaks for particular mass to charge ratio values and IMS drift time values which contain saturated data samples may be excluded when two dimensional data sets are summed or during calculation of chromatographic retention time.

Generally, for multi dimensional data sets, measurement of intensity or position in a single dimension of separation may be restricted to being calculated from data within a portion of the data from the other dimensions of separation in which no unacceptable saturation has occurred.

The present invention may be applied to instruments other than Time of Flight mass analysers which use an ADC. For example, the present invention also extends to the use of a quadrupole, an electrostatic trap, an RF ion trap, an ion mobility separator or spectrometer device ("IMS"), a field asymmetric ion mobility spectrometry ("FAIMS") device, a differential mobility spectrometer ("DMS") device or combinations or such instruments. For example, an embodiment of the present invention includes performing an MRM experiment using a triple quadrupole mass spectrometer, wherein a record of the number of saturated ADC samples during the dwell time gives an indication of the level of saturation of the ADC and may be used to correct, flag or substitute the data to improve quantitative performance.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

digitizing a plurality of individual signals or transients so as to generate a plurality of digitized signals or transients, each digitized signal or transient comprising a plurality of intensity values distributed across a plurality of sample bins;

summing, by a mass spectrometer, said plurality of digitized signals or transients or data relating to said plurality of digitized signals or transients to generate a composite mass spectral data set;

determining, by the mass spectrometer, intensity values of said plurality of digitized signals or transients that either (i) exceeded or approached a saturation threshold value; (ii) suffered from saturation or approached saturation; or (iii) result from the dynamic range of an ion detector system being exceeded or approached;

determining, by the mass spectrometer, for each sample bin of at least some of said plurality of sample bins, a proportion of instances that corresponding intensity values of said plurality of digitized signals or transients either: (i) exceeded or approached a saturation threshold value; (ii) suffered from saturation or approached saturation; or (iii) resulted from the dynamic range of an ion detector system being exceeded or approached;

producing, by a mass spectrometer, information indicating, for each sample bin of at least some of said plurality of sample bins, the proportion of instances that corresponding intensity values of said plurality of individual digitized signals or transients either: (i) exceeded or approached a saturation threshold value; (ii) suffered from saturation or approached saturation; or (iii) resulted from the dynamic range of an ion detector system being exceeded or approached; and storing the composite mass spectral data set and the information in memory.

2. A method of mass spectrometry comprising:

digitizing a plurality of individual signals or transients so as to generate a plurality of digitized signals or transients, each digitized signal or transient comprising a plurality of intensity values distributed across a plurality of sample bins;

summing, by a mass spectrometer, said plurality of digitized signals or transients or data relating to said plurality of digitized signals or transients to generate a composite mass spectral data set;

determining, by the mass spectrometer, intensity values of said plurality of digitized signals or transients that either (i) exceeded or approached a saturation threshold value; (ii) suffered from saturation or approached saturation; or (iii) result from the dynamic range of an ion detector system being exceeded or approached;

determining, by the mass spectrometer, for each sample bin of at least some of said plurality of sample bins, a measure, total or tally of the number of corresponding intensity values of said plurality of digitized signals or transients either: (i) exceeded or approached a saturation threshold value; (ii) suffered from saturation or approached saturation; or (iii) resulted from the dynamic range of an ion detector system being exceeded or approached;

producing, by a mass spectrometer, information indicating, for each sample bin of at least some of said plurality of sample bins, the measure, total or tally of the number of corresponding intensity values of said plurality of individual digitized signals or transients which either: (i) exceed or approach a saturation threshold value; (ii) suffer from saturation or approach saturation; or (iii) result from the dynamic range of an ion detector system being exceeded or approached; and storing the composite mass spectral data set and the information in memory.

3. A method as claimed in claim 1, further comprising digitizing each individual signal or transient using an Analogue to Digital Converter.

4. A method as claimed in claim 1, wherein said sample bins comprise time bins.

5. A method as claimed in claim 1, wherein the step of digitizing said plurality of individual signals or transients further comprises determining one or more ion peaks in an individual signal or transient and representing each ion peak as either: (i) an intensity value and a corresponding time, mass or mass to charge ratio value; (ii) an area value and a corresponding time, mass or mass to charge ratio value; or (iii) two or more intensity or area values and two or more corresponding time, mass or mass to charge ratio values.

6. A method as claimed in claim 1, further comprising generating said plurality of individual signals or transients in response to ions arriving at the ion detector.

7. A method as claimed in claim 1, further comprising mass analyzing ions using a mass analyzer.

8. A method as claimed in claim 1, further comprising determining for at least some or all of said individual digitized signals or transients which sample bins have an intensity value which either: (i) exceeds a saturation threshold value; (ii) suffers from saturation; or (iii) results from the dynamic range of an ion detector system having been exceeded.

9. A method as claimed in claim 1, further comprising determining for at least some or all of said individual digitized signals or transients which sample bins have a non-zero intensity value or an intensity value indicative of a signal above background noise.

10. A method as claimed in claim 1, wherein the method further comprises determining, using one or more counters, for at least some or all of said sample bins of said composite mass spectral data set a ratio A:B indicative of the proportion of instances that corresponding intensity values of said individual digitized signals or transients either: (i) exceeded or approached a saturation threshold value; (ii) suffered from saturation or approached saturation; or (iii) resulted from the dynamic range of an ion detector system being exceeded or approached; and wherein:

A is the number of instances that a particular sample bin of said composite mass spectral data set includes an intensity value related to an individual digitized signal or transient which either: (i) exceeds or approaches a saturation threshold value; (ii) suffers from saturation or approaches saturation; or (iii) results from the dynamic range of an ion detector system having been exceeded or approached; and B is the total number of individual digitized signals or transients which were summed, or the total number of individual digitized signals or transients having a non-zero intensity value or an intensity value indicative of a signal above background noise, or the total number of individual digitized signals or transients having a non-zero intensity value or an intensity value indicative of a signal above background noise for a particular sample bin.

11. A method as claimed in claim 1, further comprising summing multiple digitized signals or transients to form a summed signal.

12. A method as claimed in claim 1, further comprising flagging one or more regions of said composite mass spectral data set as either: (i) having exceeded or approached a saturation threshold value; (ii) suffering from saturation or approaching saturation; or (iii) resulting from the dynamic range of an ion detector system having been exceeded or approached.

13. A method as claimed in claim 1, further comprising applying, by a mass spectrometer, a statistical correction to one or more regions of said composite mass spectral data set and/or substituting one or more regions of said composite mass spectral data set with corresponding mass spectral data which is substantially unsaturated, less distorted or otherwise improved based on the stored information.

14. A method as claimed in claim 1, further comprising altering an operating parameter of a mass spectrometer using a control system of the mass spectrometer based on the stored information.

15. A method as claimed in claim 5, wherein the step of summing data relating to said plurality of digitized signals or transients comprises summing a plurality of said intensity or area values and said corresponding time, mass or mass to charge ratio values to generate said composite mass spectral data set.

16. A method as claimed in claim 11, further comprising determining one or more ion peaks in said summed signal.

17. A method as claimed in claim 16, further comprising determining an intensity or area value related to said one or more ion peaks.

18. A mass spectrometer comprising:

a digitizer arranged and adapted to digitize a plurality of individual signals or transients so as to generate a plurality of digitized signals or transients, each digitized signal or transient comprising a plurality of intensity values distributed across a plurality of sample bins, wherein said mass spectrometer is arranged and adapted to sum said plurality of digitized signals or transients or data relating to said plurality of digitized signals or transients to generate a composite mass spectral data set;

a memory; and a control system arranged and adapted:

to determine intensity values of said plurality of digitized signals or transients that either (i) exceeded or approached a saturation threshold value; (ii) suffered from saturation or approached saturation; or (iii) result from the dynamic range of an ion detector system being exceeded or approached;

to determine, for each sample bin of at least some of said plurality of sample bins, a measure, total or tally of the number of corresponding intensity values of said plurality of digitized signals or transients either: (i) exceeded or approached a saturation threshold value; (ii) suffered from saturation or approached saturation; or (iii) resulted from the dynamic range of an ion detector system being exceeded or approached;

to produce information indicating, for each sample bin of at least some of said plurality of sample bins, the measure, total or tally of the number of corresponding intensity values of said plurality of individual digitized signals or transients which either: (i) exceed or approach a saturation threshold value; (ii) suffer from saturation or approach saturation; or (iii) result from the dynamic range of an ion detector system being exceeded or approached; and to store the composite mass spectral data set and the information in the memory.

* * * * *